US006709241B2

(12) United States Patent
Sabini et al.

(10) Patent No.: US 6,709,241 B2
(45) Date of Patent: Mar. 23, 2004

(54) APPARATUS AND METHOD FOR CONTROLLING A PUMP SYSTEM

(75) Inventors: Eugene P. Sabini, Skaneateles, NY (US); Jerome A. Lorenc, Seneca Falls, NY (US); Oakley Henyan, Auburn, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/271,257

(22) Filed: Oct. 15, 2002

(65) Prior Publication Data

US 2003/0091443 A1 May 15, 2003

Related U.S. Application Data

(62) Division of application No. 09/275,498, filed on Mar. 24, 1999, now Pat. No. 6,464,464.

(51) Int. Cl.[7] ..... F04B 49/00
(52) U.S. Cl. ..... 417/53; 417/44.2; 417/43
(58) Field of Search ..... 417/18, 19, 20, 417/43, 44.1, 44.2, 53

(56) References Cited

U.S. PATENT DOCUMENTS 5,951,240 A * 9/1999 Mirsky et al. ..... 415/1
6,167,965 B1 * 1/2001 Bearden et al. ..... 166/250.15
2002/0090304 A1 * 7/2002 Yoo et al. ..... 417/44.1

* cited by examiner

*Primary Examiner*—Ehud Gartenberg
(74) *Attorney, Agent, or Firm*—Duane Morris LLP

(57) ABSTRACT

A controller for controlling operating parameters associated with fluid flow, speed or pressure for a centrifugal pump for pumping fluid, wherein at least one sensor is coupled to the pump for generating a signal indicative of a sensed operating condition. The controller comprises a storage device for storing data indicative of at least one operating condition and a processor in communication with the sensor and operative to perform an algorithm utilizing the at least one sensor signal and the stored data indicative of the at least one operating condition to generate a control signal, wherein the control signal is indicative of a correction factor to be applied to the pump.

15 Claims, 16 Drawing Sheets

CAPACITY CALCULATION TECHNIQUE USING USA PATENT 5,129,264

FIG. 10

WATER SPECIFIC GRAVITY VS TEMPERATURE

| TEMPERATURE | WATER SPECIFIC GRAVITY |
|---|---|
| 32 | 1.0026 |
| 40 | 1.0024 |
| 50 | 1.0020 |
| 60 | 1.0012 |
| 70 | 1.0001 |
| 80 | 0.9988 |
| 90 | 0.9973 |
| 100 | 0.9954 |
| 110 | 0.9934 |
| 120 | 0.9911 |
| 130 | 0.9886 |
| 140 | 0.9858 |
| 150 | 0.9829 |
| 160 | 0.9797 |
| 170 | 0.9764 |
| 180 | 0.9729 |
| 190 | 0.9692 |
| 200 | 0.9653 |
| 210 | 0.9613 |

FIG. 11

WATER VAPOR PRESSURE VS TEMPERATURE

| TEMPERATURE | WATER VAPOR PRESSURE |
|---|---|
| 32 | 0.22 |
| 40 | 0.27 |
| 50 | 0.39 |
| 60 | 0.58 |
| 70 | 0.84 |
| 80 | 1.18 |
| 90 | 1.63 |
| 100 | 2.21 |
| 110 | 2.95 |
| 120 | 3.91 |
| 130 | 5.13 |
| 140 | 6.66 |
| 150 | 8.58 |
| 160 | 10.95 |
| 170 | 13.85 |
| 180 | 17.37 |
| 190 | 21.61 |
| 200 | 26.67 |
| 210 | 32.64 |
| 212 | 33.96 |

FIG. 12

PUMP △ PRESSURE VS FLOW @ 4 SPEEDS

| 1780 RPM | | 3560 RPM | | 5340 RPM | | 6330 RPM | |
|---|---|---|---|---|---|---|---|
| PUMP FLOW | PUMP PRESSURE | PUMP FLOW | PUMP PRESSURE | PUMP FLOW | PUMP PRESSURE | PUMP FLOW | PUMP PRESSURE |
| 0.0 | 0.0 | 0.0 | 0.5 | 0.0 | 0.4 | 0.0 | 0.7 |
| 9.8 | 0.2 | 9.4 | 0.7 | 10.0 | 0.5 | 9.6 | 0.3 |
| 20.2 | 0.3 | 19.9 | 1.1 | 20.6 | 1.1 | 19.4 | 1.1 |
| 30.0 | 0.9 | 30.1 | 1.5 | 30.5 | 1.6 | 30.2 | 2.0 |
| 40.3 | 1.8 | 40.4 | 1.9 | 40.9 | 1.9 | 39.5 | 2.1 |
| 51.7 | 2.8 | 50.2 | 2.8 | 59.4 | 3.4 | 59.9 | 3.0 |
| 55.0 | 3.6 | 70.4 | 5.3 | 80.1 | 6.6 | 79.4 | 6.4 |
| 60.3 | 4.3 | 90.0 | 8.9 | 99.6 | 10.2 | 99.1 | 10.1 |
| 64.9 | 5.1 | 99.4 | 10.9 | 119.4 | 15.1 | 140.0 | 21.0 |
| 69.6 | 6.0 | 110.2 | 13.3 | 141.6 | 22.0 | 161.4 | 28.0 |
| 74.3 | 7.1 | 118.8 | 16.3 | 160.0 | 28.8 | 178.1 | 35.8 |
| | | 129.8 | 19.6 | 179.1 | 38.0 | 201.8 | 46.8 |
| | | 149.0 | 33.1 | 200.6 | 47.8 | 217.2 | 57.5 |

FIG. 13

PUMP PERFORMANCE DATA @ 4 SPEEDS

| 1780 RPM | | 3500 RPM | | 5340 RPM | | 6330 RPM | |
|---|---|---|---|---|---|---|---|
| PUMP FLOW | PUMP PRESSURE | PUMP FLOW | PUMP PRESSURE | PUMP FLOW | PUMP PRESSURE | PUMP FLOW | PUMP PRESSURE |
| 0.0 | 41.7 | 0.0 | 159.0 | 0.0 | 370.1 | 0.0 | 520.1 |
| 5.0 | 41.5 | 10.0 | 159.0 | 15.3 | 370.1 | 18.1 | 520.1 |
| 10.0 | 41.1 | 20.0 | 158.0 | 30.5 | 367.8 | 36.2 | 516.8 |
| 15.0 | 41.0 | 30.0 | 157.0 | 45.8 | 365.5 | 54.3 | 513.5 |
| 20.0 | 40.4 | 40.0 | 155.0 | 61.0 | 360.8 | 72.3 | 507 |
| 25.0 | 39.7 | 50.0 | 153.0 | 76.3 | 356.2 | 90.4 | 500.5 |
| 30.0 | 38.9 | 60.0 | 151.0 | 91.5 | 351.5 | 108.5 | 493.9 |
| 35.0 | 37.9 | 70.0 | 147.0 | 106.8 | 342.2 | 126.6 | 480.8 |
| 40.0 | 37.0 | 80.0 | 144.0 | 122.1 | 335.2 | 144.7 | 471.0 |
| 45.0 | 35.8 | 90.0 | 138.0 | 137.3 | 321.2 | 162.8 | 451.4 |
| 50.0 | 34.3 | 100.0 | 132.0 | 152.6 | 307.3 | 180.9 | 431.8 |
| 55.0 | 33.1 | 110.0 | 128.0 | 167.8 | 298.0 | 198.9 | 418.7 |
| 60.0 | 31.2 | 120.0 | 122.0 | 183.1 | 284.0 | 217.0 | 399.1 |
| 65.5 | 29.4 | 130.0 | 114.0 | 198.3 | 265.4 | 235.1 | 372.9 |

PUMP NPSHr DATA @ 4 SPEEDS

| 1780 RPM | | 3500 RPM | | 5340 RPM | | 6330 RPM | |
|---|---|---|---|---|---|---|---|
| PUMP FLOW | PUMP PRESSURE | PUMP FLOW | PUMP PRESSURE | PUMP FLOW | PUMP PRESSURE | PUMP FLOW | PUMP PRESSURE |
| 5.0 | 2.0 | 10.0 | 2.0 | 15.3 | 4.7 | 18.1 | 6.5 |
| 10.0 | 2.0 | 20.0 | 2.0 | 30.5 | 4.7 | 36.2 | 6.5 |
| 15.0 | 2.0 | 30.0 | 2.0 | 45.8 | 4.7 | 54.3 | 6.5 |
| 20.0 | 2.0 | 40.0 | 2.3 | 61.0 | 5.4 | 72.3 | 7.5 |
| 25.0 | 2.0 | 50.0 | 2.7 | 76.3 | 6.3 | 90.4 | 8.8 |
| 30.0 | 2.0 | 60.0 | 3.4 | 91.5 | 7.9 | 108.4 | 11.1 |
| 35.0 | 2.0 | 70.0 | 4.1 | 106.8 | 9.5 | 126.6 | 13.4 |
| 40.0 | 2.0 | 80.0 | 5.1 | 122.1 | 11.9 | 144.4 | 16.7 |
| 45.0 | 2.0 | 90.0 | 5.8 | 137.3 | 13.5 | 162.8 | 19.0 |
| 50.0 | 2.0 | 100.0 | 7.1 | 152.6 | 16.5 | 180.9 | 23.2 |
| 55.0 | 2.0 | 110.0 | 7.9 | 167.8 | 18.4 | 198.9 | 25.8 |
| 60.0 | 2.5 | 120.0 | 9.0 | 183.1 | 21.0 | 217.0 | 29.4 |
| 65.5 | 3.0 | 130.0 | 10.8 | 198.3 | 25.1 | 235.1 | 35.3 |

APPARATUS AND METHOD FOR CONTROLLING A PUMP SYSTEM

This application is a division of application Ser. No.09/275,498, filed on Mar. 24, 1999 now Pat. No. 6,464,464.

FIELD OF THE INVENTION

This invention relates generally to control systems, and more particularly to a controller for controlling flow, speed, pressure or performance of a pumping system.

BACKGROUND OF THE INVENTION

A typical centrifugal pump of the prior art comprises an impeller, rotatably mounted in a stationary casing with the rotating impeller imparting pressure and kinetic energy to the fluid being pumped, and the stationary casing guiding the fluid to and from the impeller. In a typical centrifugal pump casing, which generally includes concentric, diffusor and, volute type centrifugal casings, the rotation of the impeller imparts kinetic energy to the fluid and causes fluid flow, in a generally circular direction about the perimeter of the impeller, through the casing surrounding the impeller. At some point in the casing, the fluid flows from the perimeter of the impeller, passes a cut-water or the like through an area of the pump generally known as the discharge inlet area and through the discharge nozzle to the pump discharge.

The fluid flow can be affected by the design of the impeller, the design and size of the casing, the speed at which the impeller rotates, and design and size of the pump inlet and outlet, quality and finish of the components, presence of a casing volute and the like. In order to control fluid flow, variable frequency devices have been used to adjust the motor speed of the pump so as to regulate the flow within the pump system. It is to be noted that, as used herein, variable frequency drives are to include adjustable frequency drives (AFDs), Variable Speed Controllers (VSCs) or something similar, which operate to control electronic motor speed.

Pump speed and pressure represent important pumping system parameters, in addition to flow, which can cause the pump to operate at less than its most efficient level. Even more disadvantageously, less than optimal operating parameters may cause the pump and motor to work harder and thus wear out quicker, thereby shortening the pump's operational lifetime. According, it is highly desirable to provide a computer-controlled variable frequency device (VFD) controller which utilizes computer algorithms and sensor inputs to control flow, speed, pressure and performance of a pumping system by monitoring motor, pump and system parameters and controlling pump output via speed variations. It is also advantageous to obtain a controller operative to identify and report pump or system anomalies to a technician, to facilitate investigation and correction of any abnormalities before any serious damage to the pumping unit occurs.

SUMMARY OF THE INVENTION

A controller for controlling operating parameters associated with fluid flow, speed or pressure for a centrifugal pump for pumping fluid, wherein at least one sensor is coupled to the pump for generating a signal indicative of a sensed operating condition. The controller comprises a storage device for storing data indicative of at least one operating condition and a microprocessor in communication with the sensor and operative to perform an algorithm utilizing the at least one sensor signal and the stored data indicative of the at least one operating condition to generate a control signal, wherein the control signal is indicative of a correction factor to be applied to the pump.

There is also disclosed a method for automatically controlling operating parameters associated with a centrifugal pump according to an algorithm for pumping fluid to a discharge outlet, comprising the steps of storing in memory data values corresponding to predetermined operating conditions, obtaining sensor measurements indicative of current operating conditions, utilizing the sensor measurements and the stored data values to determine calculated data values corresponding to the current pump operating conditions, and comparing the calculated data values with the stored data values and generating a control signal indicative of a correction factor to be applied to the pump when the calculated data values differ from the stored data values by a predetermined amount.

BRIEF DESCRIPTION OF THE DRAWINGS

FIG. 10 represents a data table of stored information comprising data values of water specific gravity v. temperature.

FIG. 11 represents a data table of stored information comprising water vapor pressure v. pressure data.

FIG. 12 represents a data table of stored information comprising pump pressure v. flow data at four different pump speeds.

FIG. 13 represents a data table of stored information comprising pump performance data at four different pump speeds.

DETAILED DESCRIPTION OF THE INVENTION

Figure 1:
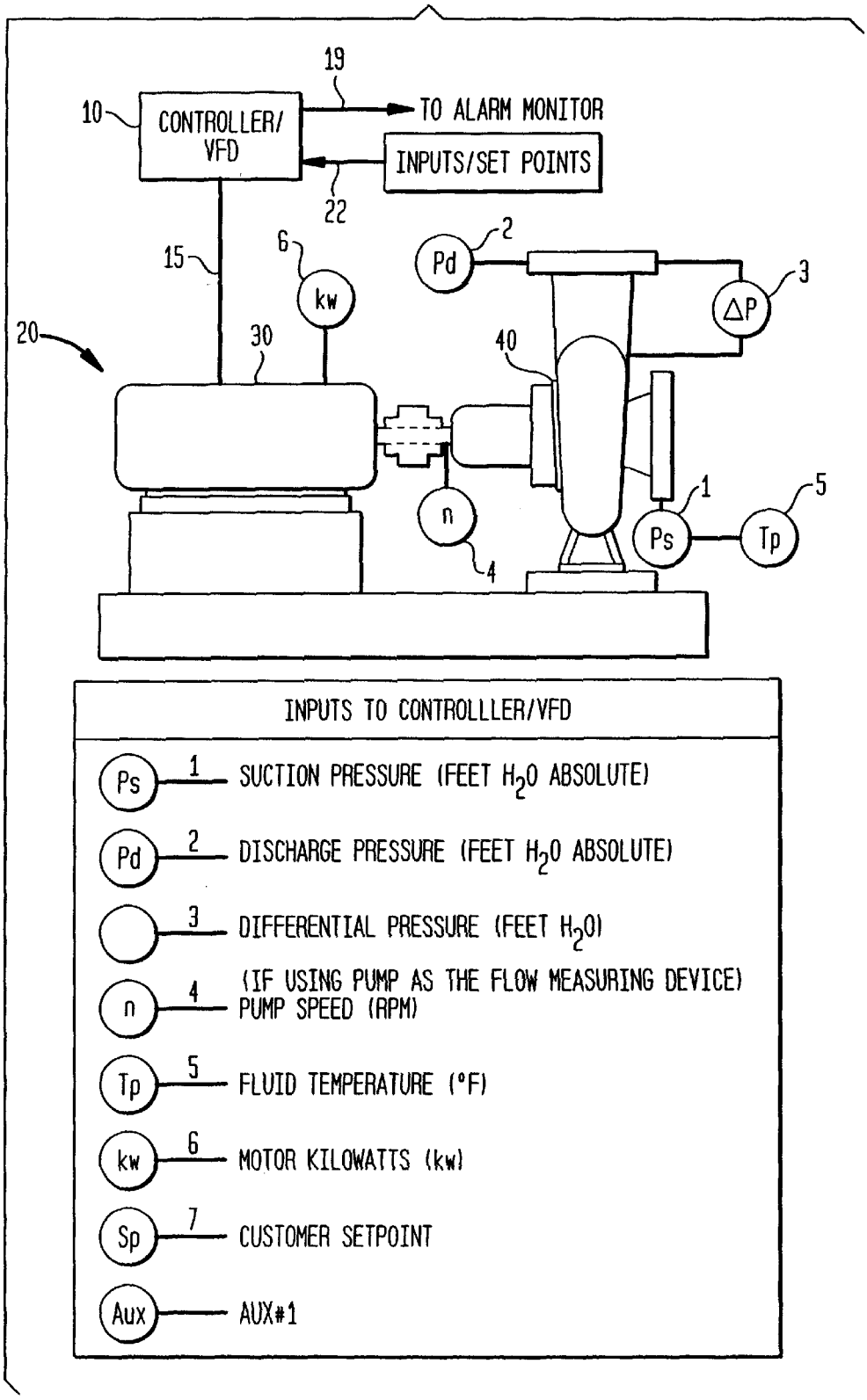
FIG. 1 is a block diagram of the pumping system and controller according to the present invention.

Referring now to FIG. 1, there is shown a controller 10 coupled to a pumping system 20 comprising a motor 30 operative for powering centrifugal pump 40. Such a centrifugal pump is depicted in U.S. Pat. No. 5,129,264 entitled CENTRIFUGAL PUMP WITH FLOW MEASUREMENT, issued Jul. 14, 1992 and incorporated herein by reference. Note that when referring to the drawings, like reference numerals are used to indicate like parts. The controller, or variable/adjustable frequency device (VFD) 10, operates to control flow, speed or pressure of the pumping system by monitoring motor, pump and system parameters and controlling pump output via speed variation and identifying and reporting pump system problems. (Note that flow measurements may be obtained using conventional flow measuring devices such as ventures, orifice plates, mag meters and the like, as well as by the technique outlined in U.S. Pat. No. 5,129,264.) Note further that the novel controller according to the present invention may be embedded within the VFD or may be externally connected between a VFD and the pumping system. More particularly, as will be described in more detail, the microprocessor containing the executable software code for controlling the motor speed may reside physically within the VFD or external to the VFD. The latter implementation permits control for use with virtually any type of VFD devices.

Figure 2:
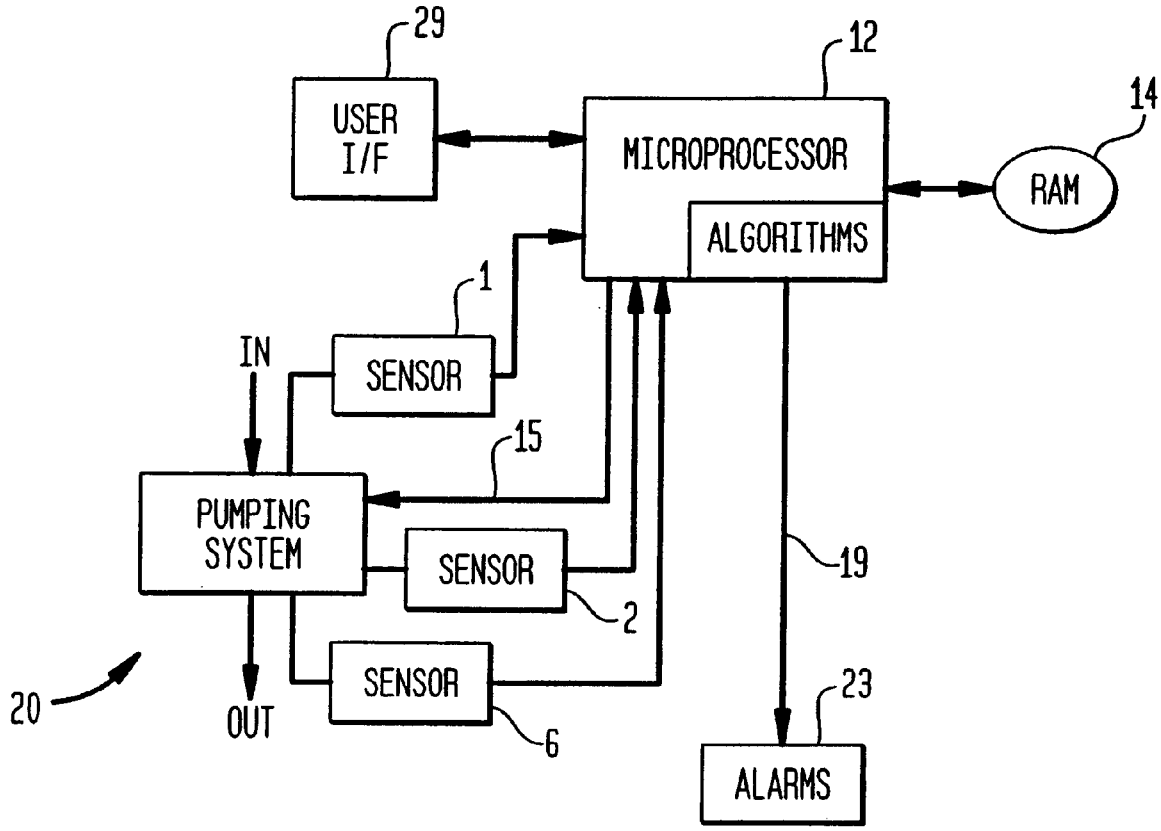
FIG. 2 is a block diagram illustrating the microprocessor and storage associated with the controller for controlling the pumping system according to the present invention.

As shown in FIG. 1, sensors 1–6 are coupled to the pumping system 20 and are operative for sensing various operating conditions associated with the pump and inputting these values to controller 10 via communication line 22. FIG. 2 shows a more detailed illustration of the controller 10 connected to the pump system 20. The controller comprises a processor 12 such as a microprocessor operative to perform software functions which utilize the sensor signals or sensor data obtained from each of the pump sensors to determine the pump operating conditions. The microprocessor 12 may be a large scale integrated (LSI) or VLSI integrated circuit controlled by software programs allowing operation of arithmetic calculations, logic and I/O operations. Other processors, including digital signal processors (DSPs) are also contemplated. Memory storage device or data base 14 such as a random access memory, (RAM) or other addressable memory is included within the controller for storing data values and tables associated with pump operating conditions and parameters. The microprocessor controller 12 receives the sensor signal data and processes the input data along with stored table data in memory 14. The microprocessor performs this processing by activating software programs which respond to the sensor inputs, as well as to pre-stored data parameters to perform a myriad of arithmetic calculations for comparison with threshold values. The software programs may be resident in microprocessor memory locations. Based on the results of those calculations and the comparison with threshold values, the software functions to generate an alarm signal indicative of an alarm condition associated with a particular operating parameter(s), and/or generates a signal for input to the pumping system to alter the current motor speed to correct for an abnormal operating condition when the difference between the calculated and stored parameter values exceed a predetermined numeric value. The controller operates to generate a control signal to VFD logic within the VFD/controller 10 indicative of a request to reduce or increase motor speed in order to correct for detected abnormal condition. The VFD then generates a signal to the motor 30 corresponding to a change in voltage and/or frequency to cause the speed of the motor to change in an amount proportional to the controller generated control signal. The controller may also operate to generate a second output control signal 19 to an alarm monitor 23 indicative of a detected abnormality in order to alert a technician of the detected condition so as to allow him to investigate and/or adjust certain parameters associated with the operating conditions.

As shown in FIG. 1, a plurality of sensor inputs from each of the sensors 1–6 are provided to the controller. These inputs include absolute pump suction pressure Ps (ref. numeral 1), absolute pump discharge pressure Pd (ref. numeral 2), differential pressure □P (ref. numeral 3), pump speed Nact (ref. numeral 4), pumpage temperature Tp (ref. numeral 5) and motor power (ref. numeral 6). Note that pump suction pressure, pump discharge pressure, and the differential pressure are typically measured in feet $H_2O$, while the pump speed is in RPMs. Fluid temperature is preferably measured in degrees Fahrenheit, while the units associated with motor power are generally kilowatts (kw). Note further that the differential pressure for flow might be direct G.P.M. measured from a flow meter, while pump speed may be from either the controller or via direct measurement. In similar fashion, motor power may also be from the controller or via direct sensor measurement. An additional input 7 such as a customer adjustable parameter or set point may also be input into the controller 10 via a user interface (see FIG. 3A) as the parameter which operates to trigger a correction factor or an alarm in response to one of the sensed operating conditions. Additional auxiliary sensor inputs 8 may also be utilized by the controller such as additional pressure gauges for measuring barometric pressure. Note also that each of the sensors are conventional sensor elements such as transducers positioned on or within the pumping system in a well-known manner that act to translate each sensed operating condition into a corresponding electronic signal for input to the controller.

Figure 3A:
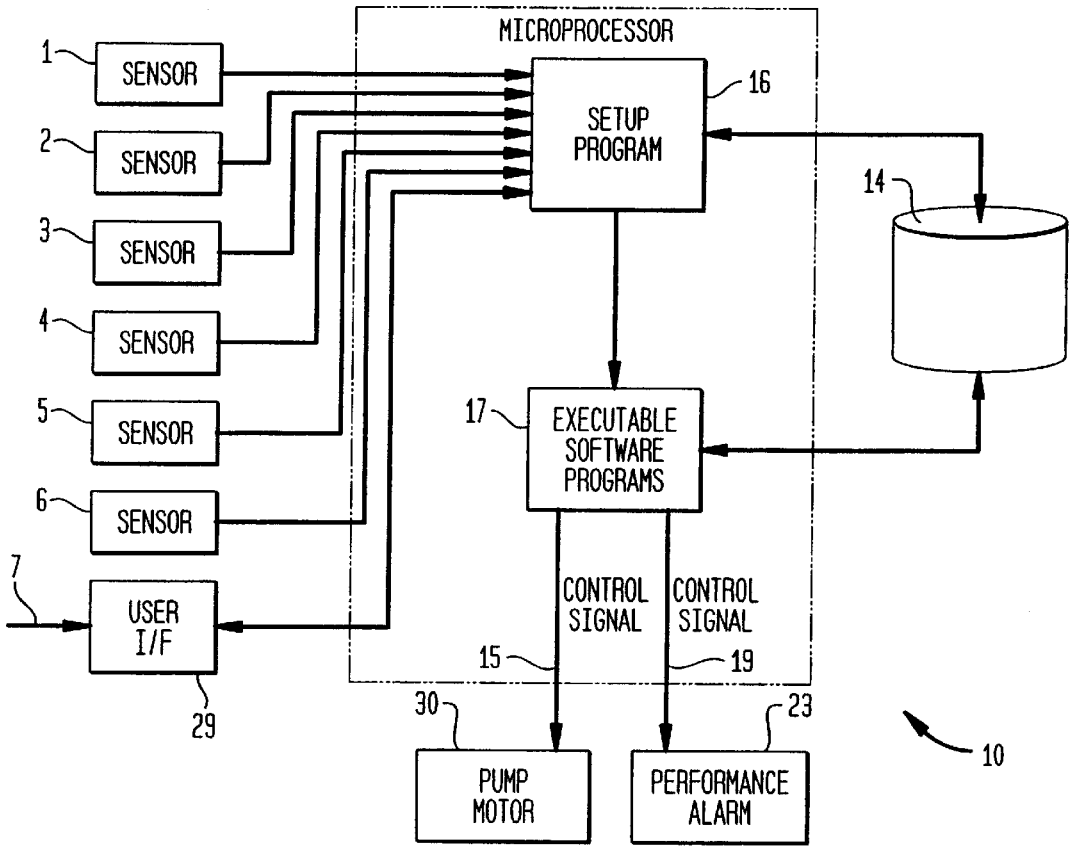
FIG. 3A is a functional block diagram of the program controller modules operative for controlling the pumping system according to the present invention.
Figure 3B:
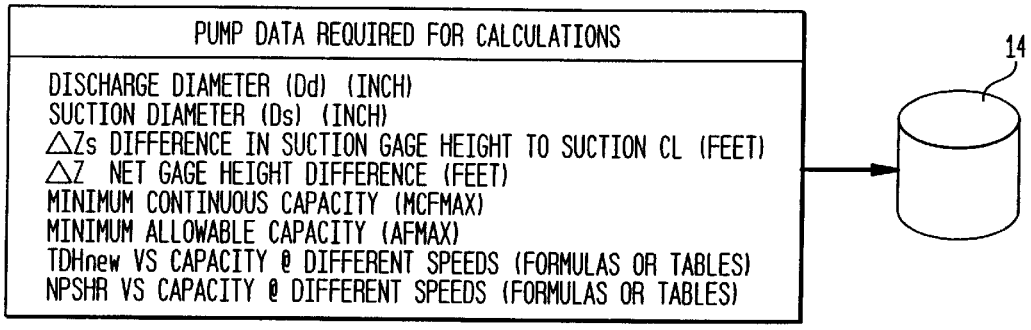
FIG. 3B is an exemplary illustration of the pump data required for the program calculations of the controller.
Figure 3C:
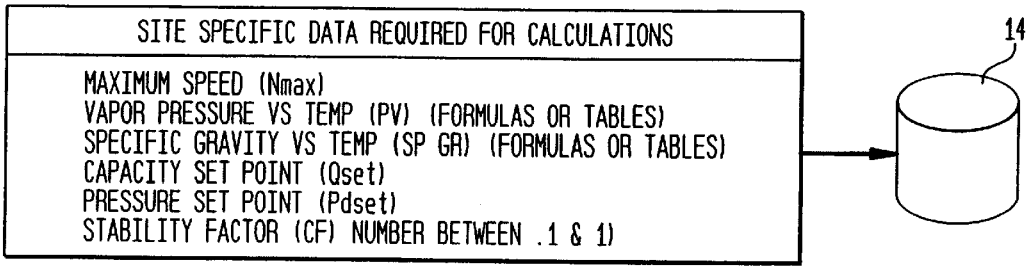
FIG. 3C is an illustration of the site specific data required for the calculations required for the controller.

FIG. 3A illustrates a block diagram of the controller software capabilities. As shown in FIG. 3A, the controller includes a plurality of software programs 17 which execute algorithms and perform calculations associated with the monitoring of motor, pump and system parameters and for controlling, identifying and reporting on these parameters. The sensor input data from the pump is input to microprocessor 12 and received by a setup program 16 which performs initialization, timing control, scaling of the input data, and receipt and storage via memory 14 of parameter values. As also shown in FIG. 3A the controller 10 includes a user interface portion 29 for receiving parameter data directly from a user, such as customer adjustable set points for trigger conditions, manual override for inputting a desired pump speed, or the site specific data (see FIG. 3C) and/or pump data (see FIG. 3B) required for the calculations performed by the software applications programs of module 17 and which are stored in memory 14. The setup program 16 initiates each of the subprograms in module 17, as will be explained in further detail below. The software associated with program 16 is operative to retrieve and display via the user interface 29 pump system parameters, inputted parameters as well as the sensor input and output conditions and calculated values resulting from the algorithmic execution in program module 17. The program also includes code which compares the user entered setting information/parameters with threshold values stored in memory so as to avoid illegal operation settings. As one can ascertain, the software module 17 has program code to perform a number of calculations for determining the pump operating condition, and based on the calculated operating condition, and based on the calculated operating condition in comparison with preset threshold values, the controller will send a control signal 15 to the pump motor 30 to either reduce or increase the motor speed. The control signal may have a variety of amplitude values and/or pulse widths indicative of the relative degree of increase or decrease of the motor speed relative to its present speed. Software programs 17 may also send a control signal 19 to an alarm indicator 23 to indicate any failure or abnormality in the system which inhibits operation of the pump. The alarm control signal may also have varying amplitude values and/or pulse widths corresponding to the relative degree of severity of the alarm condition and/or the relative amount by which the sensed operating parameter exceeds the upper or lower limits of the permissible operating conditions. Storage area 14 comprises storage media for storing site specific data required for software program execution and calculation and includes maximum pump speed, vapor pressure v. temperature, specific gravity v. temperature, capacity set point, and pressure set point and stability factor (cf). Such site specific data requirements for controller calculations are shown in FIG. 3C. As shown in FIG. 3B, pump data required for the controller calculations are stored in storage area 14, such as a database, and include pump discharge diameter, pump suction diameter, suction gauge height to suction CL, net gauge height difference, minimum continuous capacity, minimum allowable capacity, $TDH_{new}$ v. capacity at different speeds, and NPSHR v. capacity at different speeds.

Figure 3D:
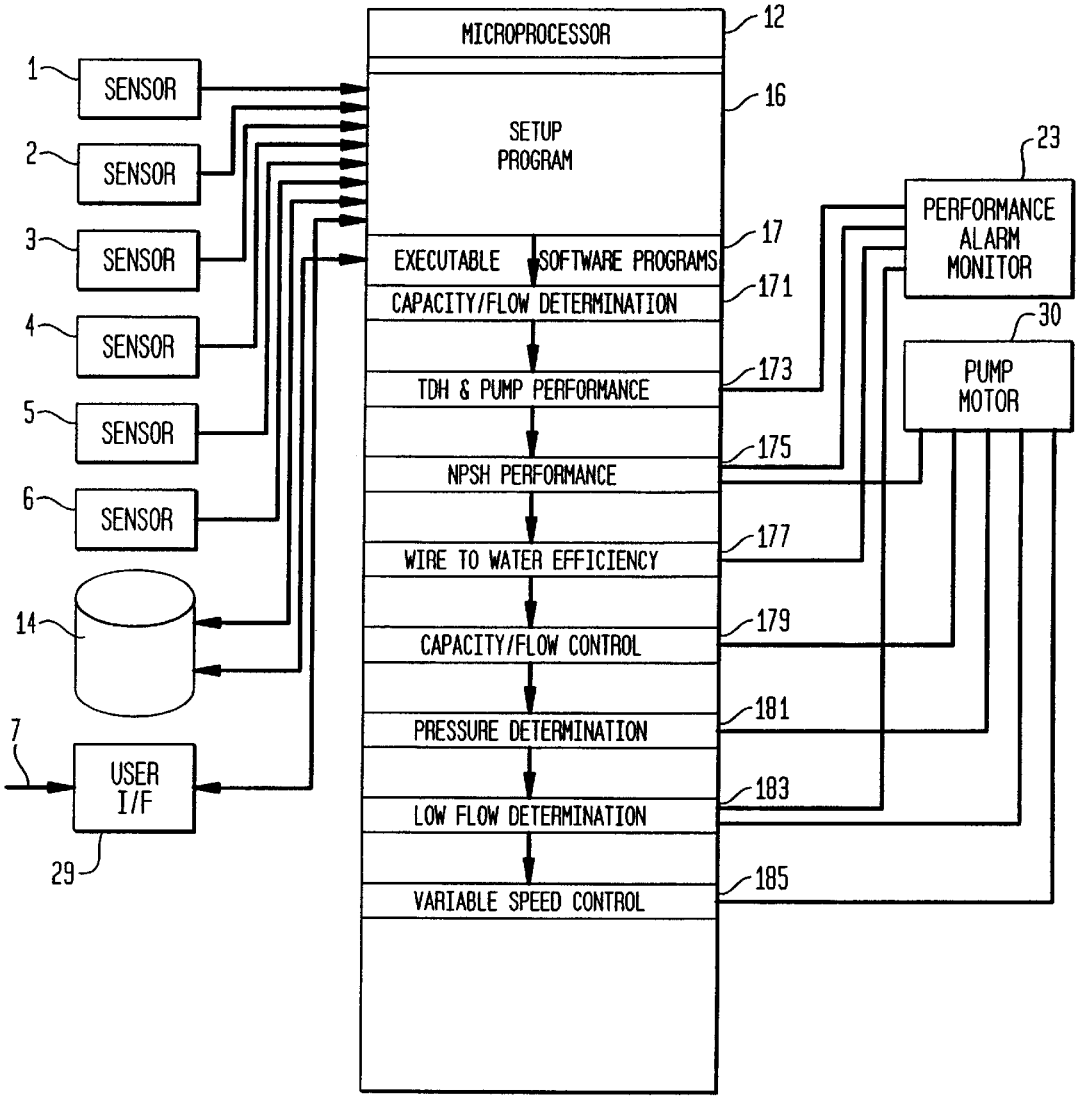
FIG. 3D is a more detailed block diagram of FIG. 3A illustrating the major functional components associated with the controller according to the present invention.

FIG. 3D shows a more detailed block diagram of the controller software capabilities of program module 17 (FIG. 3A) which generally comprise the following software modules: capacity/flow determination module 171, TDH performance logic module 173, NPSH logic 175, wire-to-water efficiency module 177, capacity flow control logic 179, pressure control logic 181, low flow logic 183, and variable speed control module 185. The processing associated with each of these modules will be described below. In the preferred embodiment, each of these algorithmic processes are executed at a frequency of 10 times per second in order to sufficiently monitor and correct for any abnormalities. As can be seen from FIG. 3D, each of the modules utilize in general, both the sensor data and stored parameter data (stored in memory 14) obtained from prior calculations to determine the pump operating conditions. The modules output control signals to activate either performance alarm 23 and/or to adjust the motor speed of motor 30.

Figure 4A:
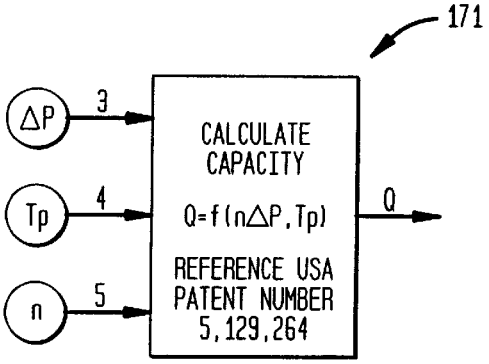
FIG. 4A is a block diagram illustrating the inputs and outputs for determining the capacity of the pumping system.

FIG. 4A shows a block diagram of the capacity determination module of the controller which receives as input the sensor inputs ΔP, $T_p$, and n in order to calculate the capacity of the pump system utilizing the technique disclosed in U.S. Pat. No. 5,129,264. Note also that the capacity Q can be obtained directly from a flow meter, as well as utilizing the above-mentioned technique.

Figure 4B:
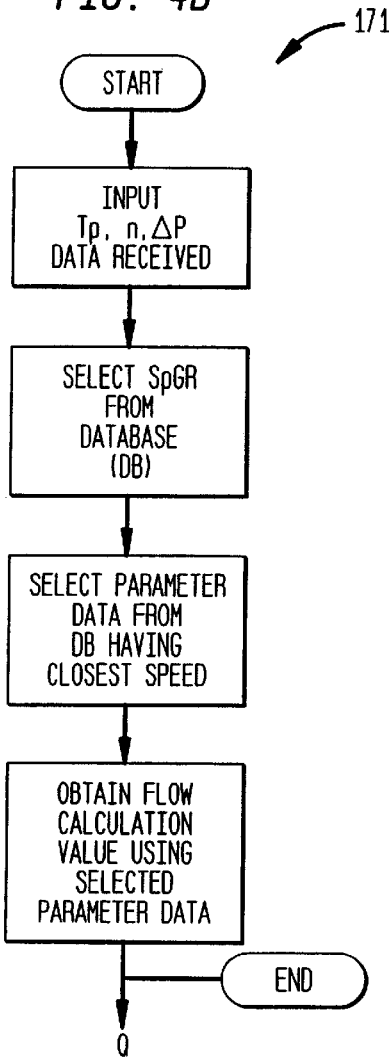
FIG. 4B represents a flow chart depicting the steps involved in obtaining the flow calculation associated with the controller according to the present invention.

FIG. 4B represents a flow diagram for obtaining the flow calculation associated with flow determination software module 171. Referring to FIG. 4B, pumpage temperature $T_p$ and pump speed n sensor data is received and the specific gravity ($S_p$GR) be selected from the parameter data in the data base comprising water specific gravity versus temperature, as shown in FIG. 10. The software then operates to select from the parameter data illustrated in FIG. 12 of pump Δ pressure versus flow at different speeds, the speed value in the data base having a value closest to the sensed pump speed from sensor 4. There exists in the data base 14 tabulated values of flow in GPM as a function of Δ ft. of pressure. The differential pressure (ΔP) input via sensor 3 is then used to determine and select the tabulated flow having a value of Δ ft. pressure closest to the sensor input ΔP value.

Figure 5A:
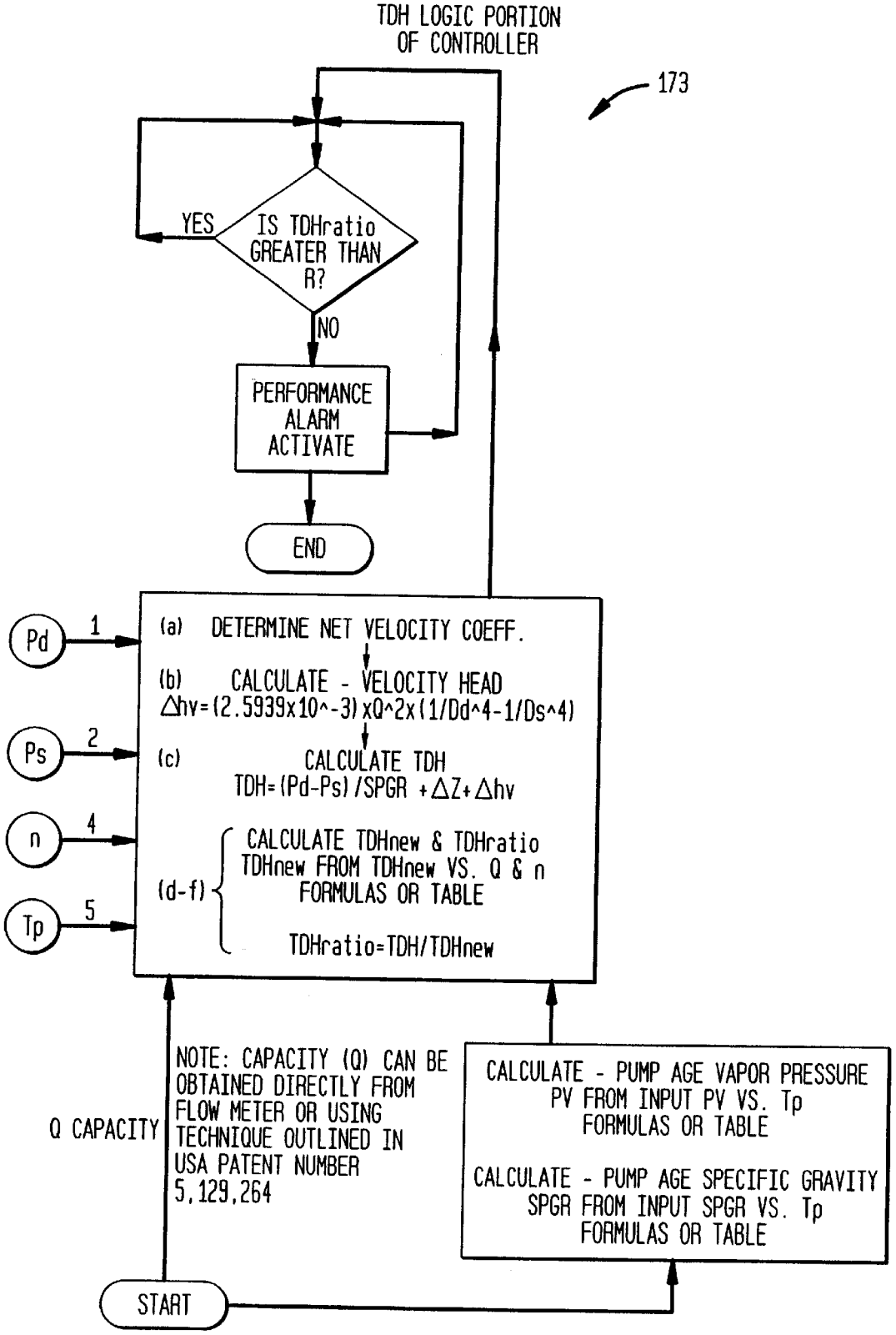
FIG. 5A is a flow chart depicting the TDH logic module associated with the controller.

Referring to FIG. 5A, there is depicted a flow diagram of the pump total dynamic head (TDH) logic portion 173 of the controller 10 which operates to determine the total dynamic head and pump performance. As shown in FIG. 5A, data values associated with pumpage fluid specific gravity are stored in tables (or as equations) in memory 14, as well as the pump data (see FIG. 3B). Such a table is illustrated in FIG. 10. The TDH logic controller also processes table data associated with pumpage fluid vapor pressure (FIG. 11) and Δ pressure v. flow for up to six speeds as shown in FIG. 12. The flow diagram of FIG. 5A illustrates the following steps of determining the pump total dynamic head and comparing the calculated value with a threshold value. If the actual pump TDH at a given flow is below a preset value (e.g. 85–95% of the table value) then a control signal is output to activate a performance alarm. The TDH determination steps are as follows:

Pump Total Dynamic Head (TDH) Determination a. Determine the Net Velocity Coefficient of this pump.

$$Cv=2.5939*10\hat{}-3*(1/Dd\hat{}4-1/Ds\hat{}4)$$

Where

Ds is pump discharge pipe diameter in inches.

Dd is pump suction pipe diameter in inches.

Dd and Ds parameters are input data.

b. Determine Net Velocity Head of this pump $$\Delta hv=Cv*Q\hat{}2$$

Where

Cv is Net Velocity Coefficient of this pump Q is pump flow in GPM from the flow calculation or directly from a Flow meter.

c. Determine TDH $$TDH=(Pd-Ps)/SG+\Delta Z+\Delta hv$$

Where

Pd is the pump discharge pressure (absolute) in ft.

Ps is the pump suction pressure (absolute) in ft.

ΔZ is net gage height difference input parameter data between Pd & Ps gages in ft.

Ahv is the Net Velocity Head and SP GR is pumpage specific gravity.

The pump performance comparison is then performed utilizing the actual pump speed, the flow value and the determined TDH value. The pump performance comparison method is identified below as follows:

Pump Performance Comparison d. The actual pump speed in flow and calculated TDH are known.

e. Select the pump performance data from the table of FIG. 13 having a speed closest to the actual pump speed.

f. Correct the actual pump flow and TDH to table speed using the affinity laws:

$$(Q1/Q2)=(N1/N2)$$

$$(TDH1/TDH2)=(N1/N2)^2$$

g. Using speed corrected pump flow and TDH values compare them to data values from the data base table in FIG. 13.

h. If actual pump TDH at given flow is less than 85% to 95% (customer adjustable set parameter) of table value, then activate pump performance alarm.

Figure 5B:
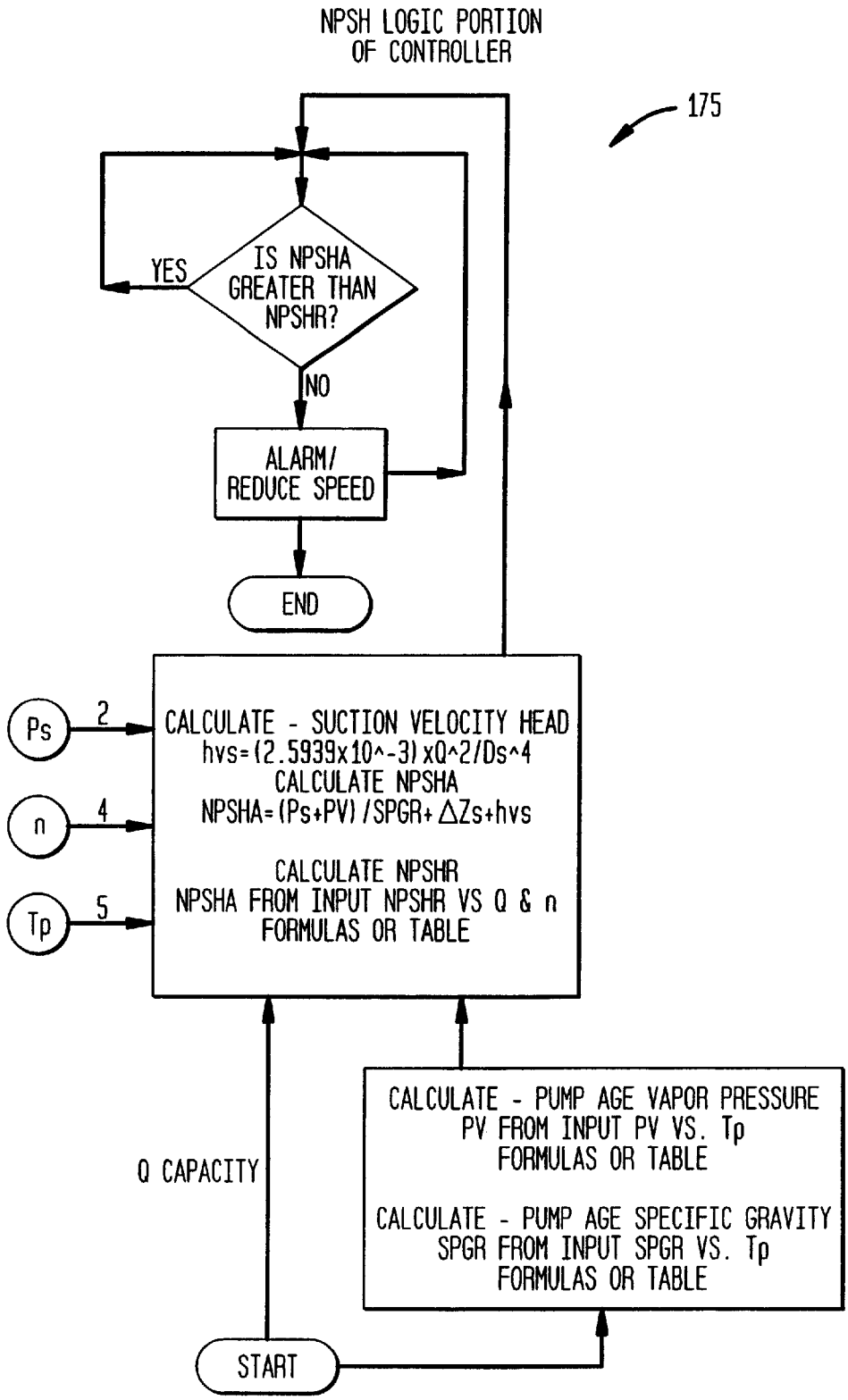
FIG. 5B is a flow chart depicting the NPSH logic module associated with the controller.

Referring now to FIG. 5B, a flow diagram of the net positive suction head (NPSH) logic controller portion 175 is illustrated. As shown in FIG. 5B, inputs to the NPSH module comprise Q capacity, vapor pressure (Pv), specific gravity, pump suction pressure, pumpage temperature and fluid temperature. The net positive suction head available (NPSHa) is then determined as follows:

Net Positive Suction Head Available (NPSHa):

a. Actual pumpage temperature is known ($T_p$)

b. Obtain the Vapor pressure (Pv) of pumpage from the stored parameter data in the data base as shown in FIG. 11.

c. Determine Suction velocity head hvs=(2.5939*10^−3)/Ds^4*$Q$^2 where Ds is pump suction pipe diameter input value in inches.

d. Determine NPSHa $$NPSHa=(Ps+Pv)/SG+\Delta Zs+hvs$$

where

Ps is pump suction pressure absolute in ft.

Pv is pumpage vapor pressure in ft.

SP GR is pumpage specific gravity determined from flow module 171.

ΔZs is the difference in suction gage height to pump suction input data in ft.

hvs is suction velocity head in ft. determined from step c.

A comparison of the NPSHa versus Net Positive Suction Head Required (NPSHr) of the pump stored in the data base 14 (see FIG. 14) is then made. If the NPSHa is less than the NPSHr, the program outputs a control signal to alarm and/or reduce the pump speed to prevent the pump from continuing to operate in a cavitating condition. The following steps depict the NPSHa v. NPSHr comparison steps.

NPSHa vs NPSHr Comparison a. Pump speed, flow and NPSHa are known.

b. Retrieve the parameter data from the data base table from FIG. 14 corresponding to the closest speed data.

c. Correct the flow and NPSHa values using affinity laws to table speed.

d. At the corrected flow, use data base table of FIG. 14 to obtain NPSHr.

e: If NPSHr>NPSHa for table speed then activate alarm via control signal; and f. output control signal to reduce speed by (NPSHa/NPSHr)^2 factor.

Note that as described in the NPSH logic portion of the controller, the calculated results are compared to the tabulated pump performance and NPSHr values, such that in the preferred embodiment, if performance is less than 95% (user selectable), then an alarm is activated. If the NPSHr of the pump is greater than the NPSHa of the system, alarm 23 is activated.

Figure 9:
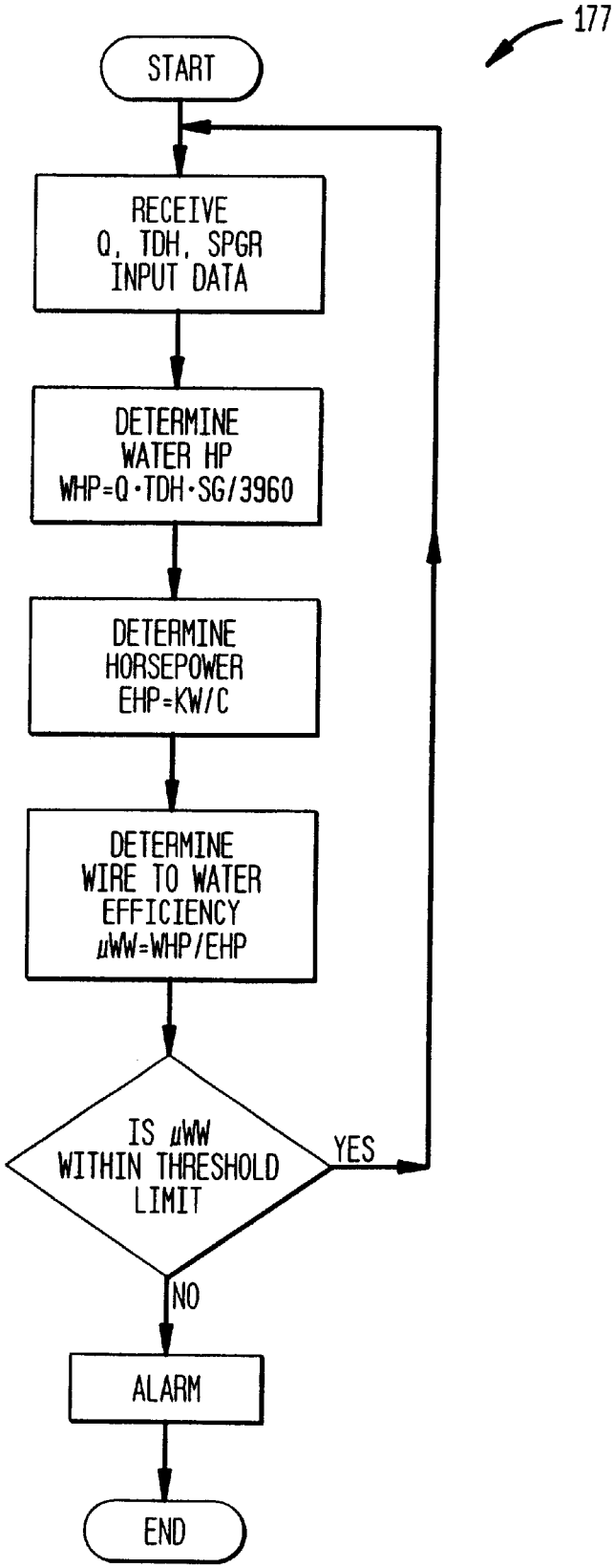
FIG. 9 is a flow chart depicting the wire-to-water efficiency logic flow module associated with the controller.

The controller 10 also includes a software program module 177 which performs a wire to water efficiency analysis. As shown in the flow diagram of FIG. 9, the steps associated with this wire to water efficiency of the pumping system is as follows:

Determine wire to water efficiency:

a. Calculate water horsepower generated $$WHP=(Q*TDH*SG)/3960$$

where

Q is pump flow in GPM from module 171

TDH is pump head in ft. from module 173

SP GR is pumpage specific gravity b. Calculate electrical horsepower used.

$$EHP=KW/0.746$$

where

KW is kilowatt input in kilowatts (kw).

c. Calculate wire to water efficiency of pumping system $\mu$ww=WHP/EHP.

Figure 6:
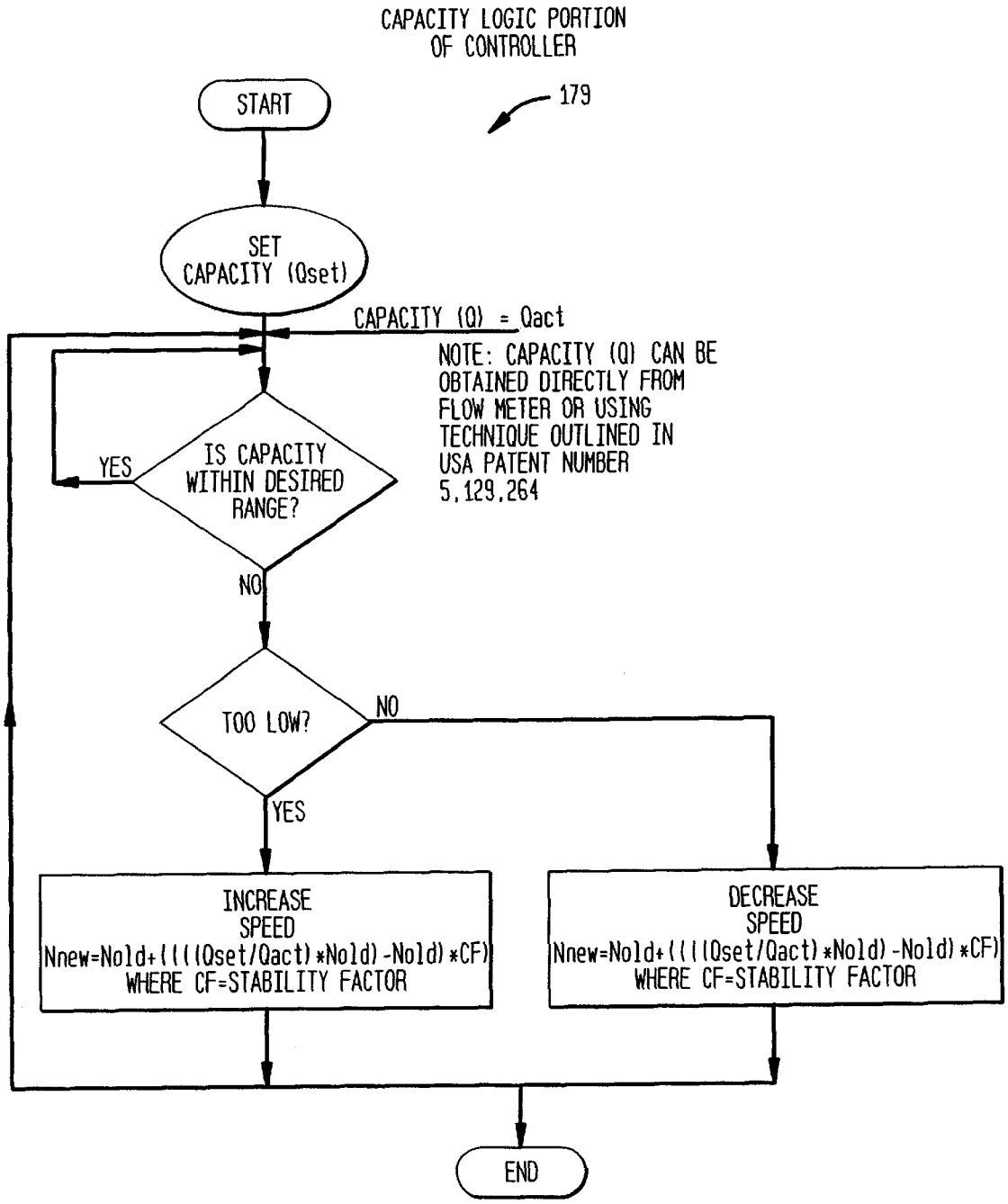
FIG. 6 is a flow chart depicting the capacity logic module associated with the controller.

FIG. 6 illustrates capacity logic portion 179 of the controller 10. As illustrated in FIG. 6, the processing for flow control comprises setting the capacity (Q set), determining whether the capacity is within a desired range by comparing the actual capacity Qact to the Qset value, and adjusting the speed by a factor $$Nnew=Nold+((((Qset/Qact)*Nold)-Nold)*CF)$$

where Nold is the actual pump speed and CF is a stability factor set by customer (typically 0.1 to 1.0). CF is used to prevent overcorrecting and instability in the control of the pump flow and speed as shown in FIG. 6, the output control signal operates to either increase or decrease motor speed to the pump motor.

Figure 7:
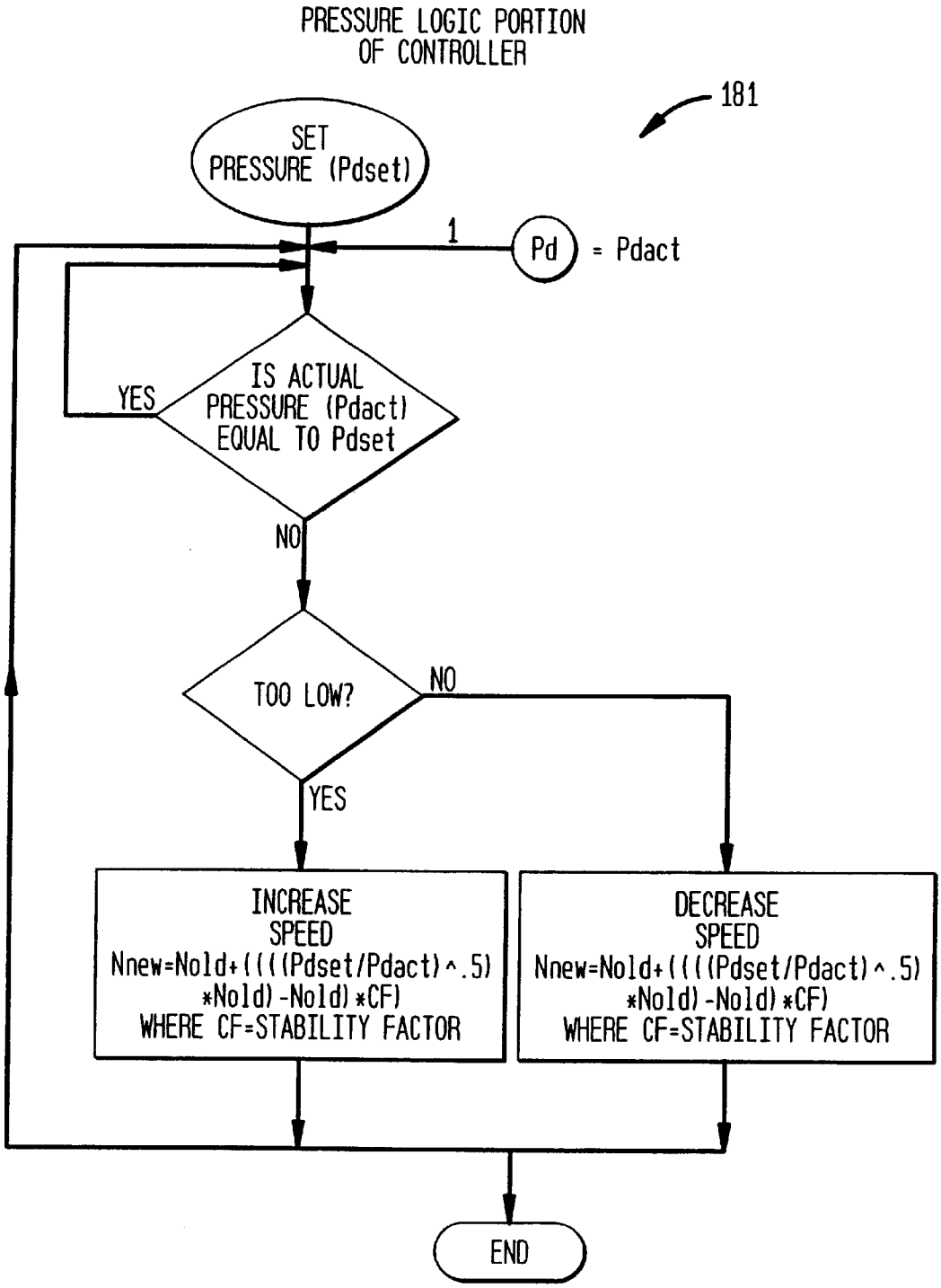
FIG. 7 is a flow chart depicting the pressure logic module associated with the controller.

FIG. 7 illustrates a process variable control for pressure determination module 181 associated with the controller 10. As shown in FIG. 7, the steps associated with this variable control comprises:

Process Variable Control for Pressure:

a. Comparing Pdact (actual Pd) to the Pdset. (Pump Discharge Pressure)

b. Adjusting speed by a factor Nnew=Nold+((((Pdset/Pdact)^0.5 * Nold)−Nold) * CF)

where:

Nold is the actual pump speed,

CF is a stability factor set by customer (typically 0.1 to 1.0), and

CF is used to prevent overcorrecting and instability in the control of the pump pressure and speed.

As shown in FIG. 7, the output control signal of module 181 operates to either increase or decrease the pump motor speed.

Figure 8:
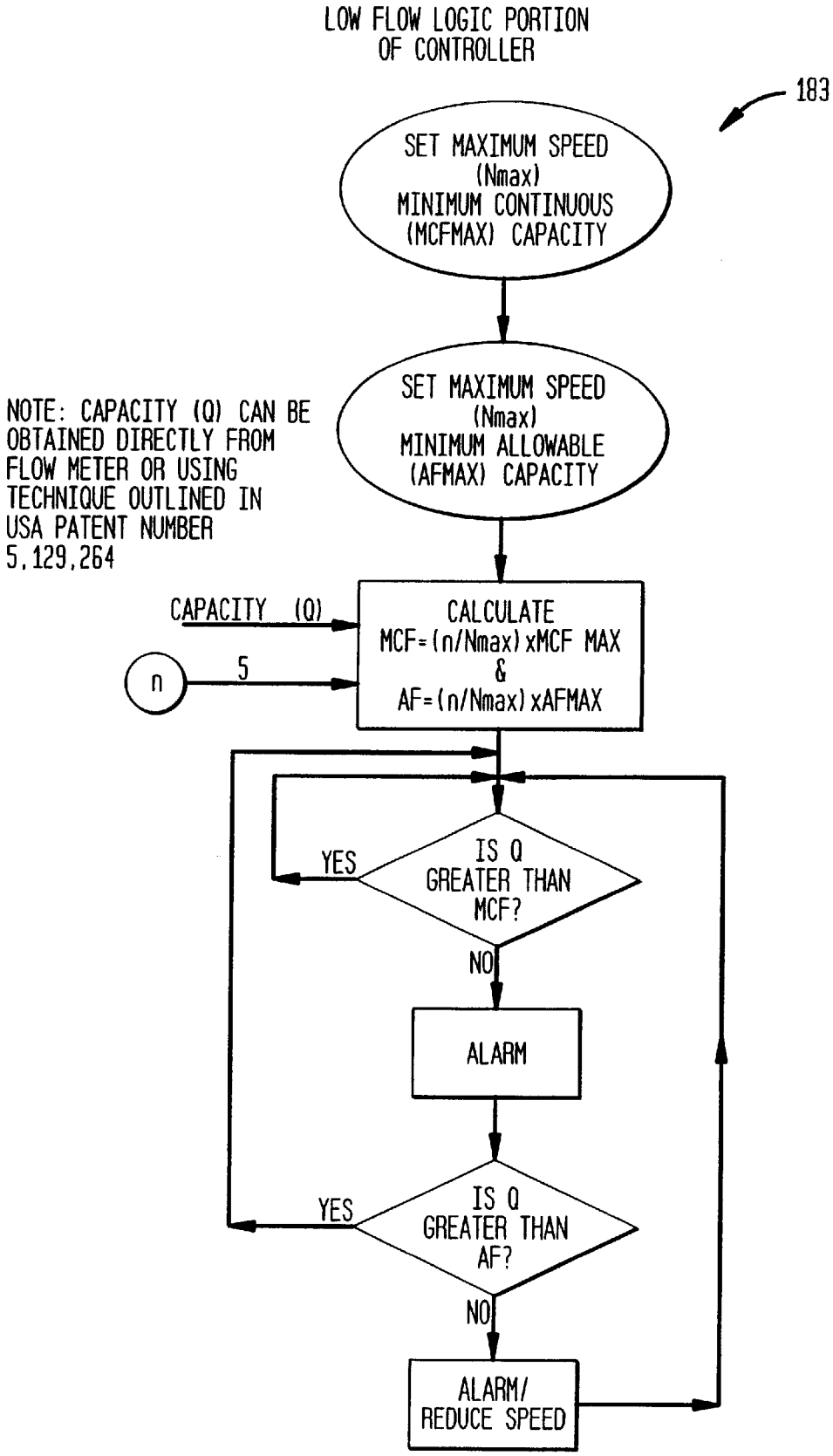
FIG. 8 is a flow chart depicting the low flow logic module associated with the controller.

FIG. 8 illustrates a flow diagram of the low flow logic module 183 portion of the controller 10 which compares the operating pump flow to the pump's calculated minimum continuous flow. If the actual flow rate is below the minimum continuous flow, an alarm is activated. The operating pump flow is also compared to the pump's calculated minimum allowable flow, such that if the actual flow rate is below the minimum allowable flow, the software program operates to provide a control signal to activate an alarm and/or reduce pump speed to prevent the pump from continuing to operate below the minimum allowable flow. The following steps depict each of the above-identified conditions.

Below Minimum Continuous Flow:

a. Input minimum continuous flow (mcf) of the pump at the maximum (max) speed in gpm into database memory.

b. The mcf at any speed is (N1/Nmax) * mcfmax.

c. If the Qact is<mcf for a given speed, generate alarm signal to notify customer that flow is below the minimum continuous flow level.

Below Minimum Allowable Flow:

a. Input allowable flow (af) of the pump at the maximum (max) speed in gpm into database.

b. The af at any speed is (N1/Nmax) * afmax.

c. If the Qact is<af for a given speed, output control signal to alarm customer that flow is below the minimum allowable flow level.

d. If Qact is<af output control signal to reduce speed of pump to a minimum (ie 1000 rpm) to eliminate damage to the pump.

e. User interface resumes control once the cause of the below allowable flow condition has been eliminated.

Figures 14, 15:
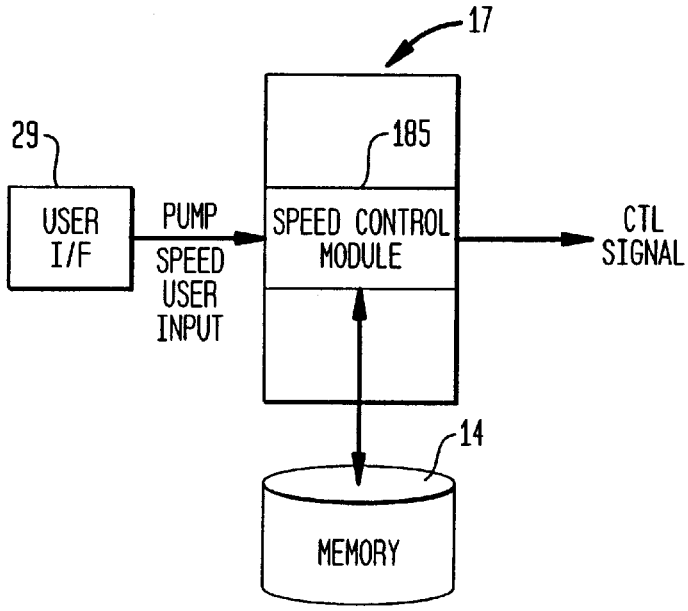
FIG. 14 represents a data table of stored information comprising pump NPSHr data at four different pump speeds.
FIG. 15 is a block diagram depicting the functioning of the variable speed control module associated with the controller.

The variable speed control module 185 operates as depicted in the flow diagram of FIG. 15. As shown in FIG. 15, the desired pump speed is selected and input to the module via user interface 29. The selected pump speed input to module 185 via a user is stored in the data base 14 and a control signal is output from the controller to set the desired speed of motor 30.

As one can ascertain, the controller operates to notify and correct pump operating parameters including pump flow, pump performance, pump pressure and speed in order to effectively control and maintain the pump in an efficient and active state.

Figure 16:
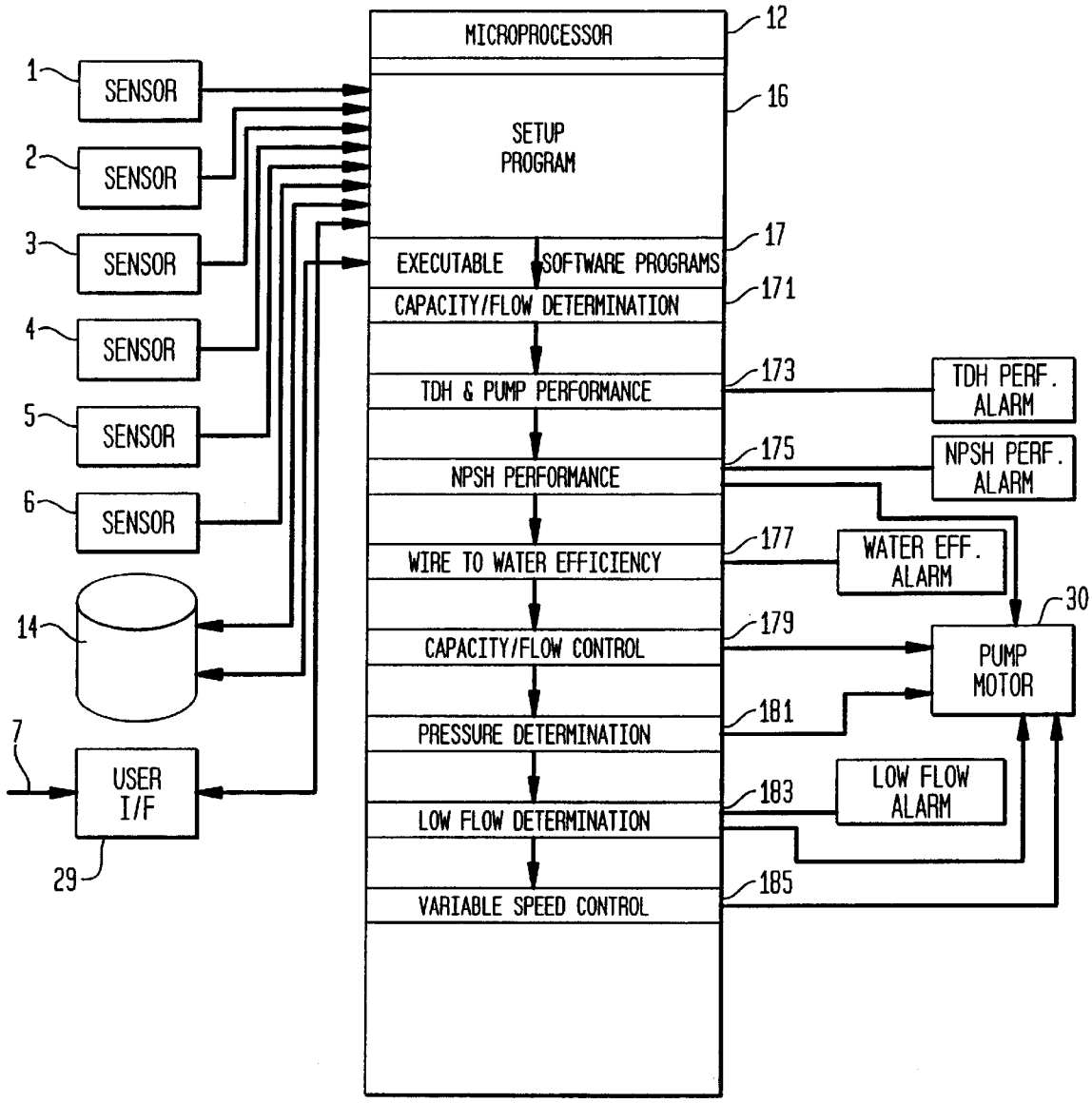
FIG. 16 is a detailed block diagram depicting the major functional software programs associated with the controller coupled to separate alarm monitor devices according to the present invention.

It will be understood that the embodiments described herein are exemplary, and that a person skilled in the art may make many variations and modifications without departing from the spirit and scope of the invention. For example, while there has been shown a single pump performance alarm monitor, it is to be understood that each of the software application modules may provide a separate control signal which may be directed to a separate respective alarm monitor including an LED or a buzzer which would alert the technician to the precise overflow or overload condition. Such a set of alarm monitors respectively coupled to the software modules is illustrated in FIG. 16. The alarm monitors may be connected to a separate computing system or computer network which may operate to alert an individual at a location remote from the location of the pump. The application program code associated with setup program 16 and 17 may be written in a variety of higher level languages such as basic, C, or other high level languages and operates in combination with conventional operating systems in a well known fashion so as to properly communicate with the pump sensors, pump motor, and any peripheral devices. Moreover, as previously discussed, the controller may be housed within a VFD for receiving pump sensor data and outputting control signals to adjust the pump motor speed, or may be external to a VFD and located within an interface module and connected to the VFD, such that all input data is sent to the controller via the VFD and a control signal to adjust motor speed is output from the controller to the VFD for adjusting the speed of the electronic pump motor. All such modifications are intended to be included within the scope of the invention as defined in the appended claims.

What is claimed is:

1. A method of controlling the operating parameters associated with fluid flow, speed or pressure of a centrifugal pump of a fluid pumping system comprising the steps of:

storing predetermined data values associated with at least one operating condition of the centrifugal pump;

measuring at least one operating parameter associated with the centrifugal pump;

associating subsets of said predetermined stored data values with the measured operating parameters to obtain calculated data values corresponding to the measured operating parameter; and comparing said calculated data values with a corresponding threshold value; and generating a control signal in response thereto for correcting the speed thereof in order to maintain a requisite pump flow or pressure, the control signal including a stability factor that prevents overcorrection of the pump speed.

2. The method according to claim 1, wherein the control signal is indicative of an alarm condition.

3. The method according to claim 1, wherein said stored predetermined data values include vapor pressure as a function of temperature, specific gravity as a function of temperature, and the centrifugal pump performance as a function of the centrifugal pump's motor speed.

4. The method according to claim 3, wherein said stored predetermined data values further include differential pressure and flow as a function of the centrifugal pump's motor speed and net positive suction head as a function of the centrifugal pump's motor speed.

5. The method according to claim 4, wherein said measured operating parameter include pump suction pressure, pump discharge pressure, pump speed, and pump differential pressure.

6. The method according to claim 5, wherein said measured operating parameter further include pumpage temperature, pump motor power, and user set points.

7. The method according to claim 1, wherein the step of storing predetermined data values comprises the step of storing pumpage fluid specific gravity, fluid vapor pressure, differential pressure and flow as a function of motor speed, pump performance parameters as a function of motor speed, and NPSH parameters as a function of motor speed.

8. The method according to claim 7, wherein the steps of obtaining calculated data values and comparing said calculated data values with a threshold value further comprises:

determining a fluid flow;

calculating a total dynamic head (TDH) value associated with said pump using said determined fluid flow;

selecting from said stored predetermined data values those data values having a speed closest to measured pump motor speed operating parameter;

correcting actual pump flow and said TDH values using said stored predetermined data values associated with pump motor speed to obtain corrected pump flow and TDH values;

comparing said corrected pump flow and TDH values to said threshold values; and generating a control signal to activate an alarm in response thereto when the difference between the corrected pump flow and TDH values and the threshold values is greater than said preset value.

9. The method according to claim 8, wherein the steps of obtaining calculated data values and comparing said calculated data values with a threshold value further comprises:

determining net Positive Suction Head Available data value (NPSHa);

comparing said NPSHa with predetermined data values corresponding to a stored value of NPSH; and generating a second control signal to activate an alarm when the stored value of NPSH is greater than said NPSHa value.

10. The method according to claim 9, wherein the steps of obtaining calculated data values and comparing said calculated data values with a threshold value further comprises:

generating a third control signal to reduce pump motor speed by a predetermined amount when the stored value of NPSH is greater than said NPSHa value.

11. The method according to claim 9, wherein the steps of obtaining calculated data values and comparing said calculated data values with a threshold value further comprises:

calculating a minimum continuous pump flow and comparing with the determined fluid flow; and generating a third control signal to activate an alarm when the determined fluid flow is less than the calculated minimum continuous flow.

12. The method according to claim 10, wherein the steps of obtaining calculated data values and comparing said calculated data values with a threshold value further comprises:

calculating a minimum allowable pump flow and comparing with the determined fluid flow; and generating a fourth control signal to activate an alarm when the determined fluid flow is less than the calculated minimum allowable flow.

13. A method of controlling the operating parameters associated with fluid flow, speed or pressure of a centrifugal pump of a fluid pumping system comprising the steps of:

storing predetermined data values for pumpage fluid specific gravity, fluid vapor pressure, differential pressure and flow as a function of motor speed, pump performance parameters as a function of motor speed, and NPSH parameters as a function of motor speed;

measuring at least one operating parameter associated with the centrifugal pump;

associating subsets of said predetermined stored data values with the measured operating parameters to obtain calculated data values corresponding to the measured operating parameter; and comparing said calculated data values with a corresponding threshold value; and generating a control signal in response thereto for correcting the speed thereof in order to maintain a requisite pump flow or pressure;

the steps of obtaining calculated data values and comparing said calculated data values with the corresponding threshold value further comprises:

determining a fluid flow;

calculating a total dynamic head (TDH) value associated with said pump using said determined fluid flow;

selecting from said stored predetermined data values those data values having a speed closest to measured pump motor speed operating parameter;

correcting actual pump flow and said TDH values using said stored predetermined data values associated with pump motor speed to obtain corrected pump flow and TDH values;

comparing said corrected pump flow and TDH values to said threshold values; and generating a control signal to activate an alarm in response thereto when the difference between the corrected pump flow and TDH values and the threshold values is greater than said preset value;

the steps of obtaining calculated data values and comparing said calculated data values with a threshold value further comprises:

comparing the determined fluid flow Qact with a threshold value Qset corresponding to a user settable fluid flow; and generating a control signal to adjust motor speed by a factor of Nnew=Nold+((((Qset/Qact)*Nold)−Nold)*CF) where Nold is the measured motor speed environmental parameter data and CF represents a user settable value.

14. The method according to claim 13, wherein the steps of obtaining calculated data values and comparing said calculated data values with a threshold value further comprises:

comparing the determined pump discharge pressure Pdact with a threshold value Pdset corresponding to a predetermined stored discharge pressure data value; and generating a control signal to adjust motor speed by a factor of Nnew=Nold+(((((Pdset/Pdact)^0.5)*Nold)−Nold)*CF).

15. A method of controlling the operating parameters associated with fluid flow, speed or pressure of a centrifugal pump of a fluid pumping system comprising the steps of:

storing data indicative of at least one operating condition of the centrifugal pump;

measuring at least one operating parameter associated with the centrifugal pump; and generating a control signal which is applied to the centrifugal pump, for correcting the speed thereof in order to maintain a requisite pump flow or pressure, said control signal including a stability factor that prevents overcorrection of said pump speed, wherein the control signal is generated using the measured operating parameter and the stored data.

* * * * *